United States Patent [19]

Schulz et al.

[11] 3,999,362

[45] Dec. 28, 1976

[54] OPEN END SPINNING MACHINE

[75] Inventors: Günter Schulz, Ebersbach; Gisbert Köhler, Offingen, both of Germany

[73] Assignee: Zinser Textilmaschinen GmbH, Ebersbach, Germany

[22] Filed: Apr. 18, 1975

[21] Appl. No.: 569,288

[30] Foreign Application Priority Data

Apr. 18, 1974 Germany ..... 2418590

[52] U.S. Cl. ..... 57/34 R; 57/58.95

[51] Int. Cl.[2] ..... D01H 15/00

[58] Field of Search ..... 57/34 R, 58.89, 58.95, 57/80, 81

[56] References Cited

UNITED STATES PATENTS

| | | | |
|---|---|---|---|
| 3,354,631 | 11/1967 | Elias et al. | 57/58.95 |
| 3,455,095 | 7/1969 | Makcham et al. | 57/34 R |
| 3,695,017 | 10/1972 | Hori et al. | 57/34 R |
| 3,874,154 | 4/1975 | Stahlecker et al. | 57/58.95 |
| 3,952,491 | 4/1976 | Sharychenkov | 57/34 R |

*Primary Examiner*—John Petrakes
*Attorney, Agent, or Firm*—Edwin E. Greigg

[57] ABSTRACT

A thread breakage repair apparatus for use in open-end spinning machines includes a fixture which holds the thread and trims its broken end and it also includes a movable assembly, on which a drawoff tube is mounted which is connected to a source of suction. This drawoff tube is brought close to the end of the thread held by the clamping and severing fixture, whereupon a controller releases the clamped thread which is then aspirated into the interior of the drawoff tube. The mechanical transport mechanism for the thread may be reversed in motion by the controller, permitting already spun thread to be backspaced so that the end of the thread may be reattached to the fibers located in the spinning rotor. The drawoff tube may also be of the telescoping type whose extension is determined by the controller.

10 Claims, 3 Drawing Figures

OPEN END SPINNING MACHINE

BACKGROUND OF THE INVENTION

The invention relates to an open end spinning machine which includes an apparatus for re-attaching a thread which had previously been held in a clamping fixture and which had been severed at equal, predetermined distances from the fiber collection groove of the spinning rotor. The spinning machine further includes thread drawoff tubes through which air may enter the spinning rotors.

In a known machine of this type, the fixtures which clamp and sever the threads are so disposed that the clamping and severing operation takes place within the thread drawoff tubes, i. e. it takes place in relatively close proximity to the fiber collection groove of the spinning rotor. The thread drawoff mechanism must be stopped very rapidly and abruptly in order that a thread, whose breakage is sensed by a sensor also located in close proximity to the clamping and severing fixture, is stopped while it is still in the effective operating region of the clamping and severing fixture. Since the thread drawoff tube is usually fastened in or on a movable cover of the spinning rotor housing, the clamping and severing fixture and the sensor must also be mounted on this movable cover and this requires expensive clutches and connections for providing drive power from the spinning machine.

DT-PS No. 1,289,472 has disclosed a clamping device disposed outside of the thread drawoff tube and this device is capable of clamping a thread whose broken end still lies within the tube and the thread may be guided back into the fiber collection groove for reattachment after being unclamped. However, this reattachment attempt may fail because the uncut ends of the threads are unequal in length, shape and the same. At the restarting of such open end spinning machine therefore there is a risk that many threads are not reattaching to the unspun fibres in the spinning rotors.

OBJECT AND SUMMARY OF THE INVENTION

It is a principal object of the invention to provide an apparatus for clamping and severing threads in an open-end spinning machine and re-attaching them to unspun fibers.

It is a further object of the invention to provide an apparatus for clamping, severing and reattaching threads which does not require the installation of actuating means in the cover of the spinning rotor housing.

Yet another object of the invention is to provide an apparatus for clamping and severing the threads which had broken due to the stopping of the open end spinning machine for a reliable re-attachment of the cut off ends to the unspun fibers in the affecting grooves of the spinning rotors during the restarting of the open end spinning machine.

These objects are attained, according to a first exemplary embodiment of the invention, by providing a clamping and severing fixture which engages the thread outside of the thread drawoff tubes, in relation to the clamping and severing fixture, so that a relative position may be established in which the cut threads held in the clamping fixture lie definitely in the effective suction region of the orifices of the drawoff tubes.

In a second exemplary embodiment of the invention, the thread drawoff tube may be customarily rigid and may be rigidly attached to the housing of the spinning rotor. A setting mechanism may be provided for moving all of the spinning rotor housings of the spinning machine in unison or, alternatively, each housing may have its own setting mechanism. The former construction has the advantage of being less expensive, whereas the latter construction has the advantage that it may be used for repairing single thread breakages.

In a third exemplary embodiment, the change of position of the rotor housing performs two distinct functions.

In yet other cases, two further exemplary embodiments may be more advantageous. In these embodiments, the housing containing the spinning rotors may be locally fixed. Even in this case, it may be advantageous if a single setting mechanism moves all of the mutually interconnected orifices in the spinning machine or else that each individual orifice or each telescoping tube with an orifice has its own setting mechanism.

The invention will be better understood as well as further objects and advantages will become more apparent from the ensuing detailed description of the three exemplary embodiments taken in conjunction with the drawing.

DESCRIPTION OF THE PREFERRED EMBODIMENTS

Open-end spinning machines are well known to the person skilled in the art, and therefore, only those machine elements which serve to explain the invention are shown and only schematically. Therefore, an open-end spinning machine which is constructed according to the invention may be identical or similar to a known open-end spinning machine in all respects except those which are subject to the conditions of the invention.

Figure 1:
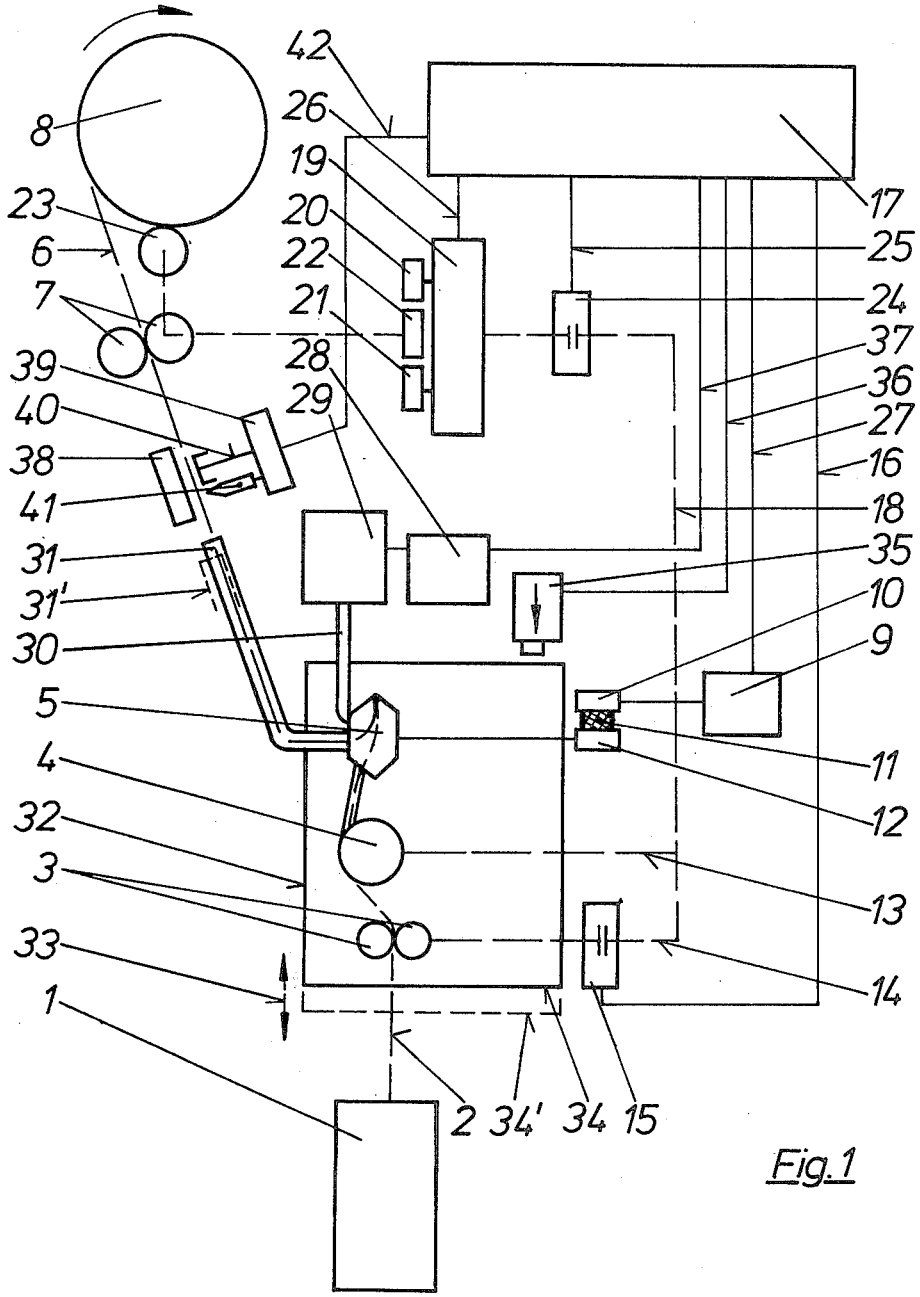
FIG. 1 is a schematic representation of those elements of an open-end spinning machine which are required for the explanation; only one of the plurality of spinning mechanisms of this machine being shown.

Turning now to FIG. 1, it may be seen that, in known manner, the fibrous material 2 which is to be spun into threads within the driven spinning rotor 5 is pulled from a can or receptacle 1 by the input feed roller pair 3. The material is delivered to a spreader 4 which separates the material into individual fibers which are pneumatically aspirated through a thread supply channel into a spinning rotor 5. Here, the material is spun into a thread 6 which is continuously pulled out through a thread drawoff tube 31 by a thread drawoff roller pair 7 and is subsequently wound up on a wind-up spool 8. The described machine members are driven by a motor 9 which drives a plurality of identical spinning mechanisms which are all part of a single spinning machine but of which FIG. 1 shows only a single one. The belt takeoff 10 of the motor 9 drives a tangential drive belt 11 which is guided along the machine and to which the whorl 12 of the spinning rotor 5 is pressed for rotation. The belt 11 also drives other spinning rotors which are not shown and, preferably, it drives all of the spinning rotors of this machine. Broken lines 13 and 14, extending from the motor shaft, represent transmission drive means located between the motor 9 and the spreader 4 or the feed roller pair 3. The connection 14 also contains a switching clutch 15 which is shown by a line 16 to be connected to a controller 17. A broken line 18 extending from the shaft of motor 9 is intended to suggest a further driving transmission between the motor 9 and a transmission 19 whose output gear 20 and 21 rotate in mutually opposite directions and may be alternately coupled to a drive gear 22. The drive gear 22 is in driving engagement with a drive roller 23 of the wind-up spool 8, as suggested by the broken line. The connection 18 contains a switching clutch 24 which is connected by a line 25 to the controller 17 which also communicates with the transmission 19 through a line 26 and with the motor 9 through a line 27.

The spinning machine includes a second motor 28 which drives a low-pressure generator 29 (suction blower) which communicates through a pipeline 30 with the space surrounding the spinning rotor 5, i. e. with a chamber of the housing, not shown in greater detail, which contains the spinning rotor. The low-pressure generator 29 generates the reduced air pressure in this chamber by which the fibrous material 2 is pulled into the interior of the spinning rotor 5. In the same manner, outside air is drawn through the thread drawoff tube 31 which extends from a central opening in the spinning rotor 5 toward the thread drawoff roller pair 7. The thread drawoff tube 31 extends from a reciprocable housing member 32 which is its support means and which is also the support means and the housing for the rotor 5, for the spreader 4 and for the feed roller pair 3.

The housing member 32 is reciprocably mounted on the spinning machine for motion in the directions indicated by the double arrow 33, for example on rails or by a column-type guide mechanism. The position shown in the drawing is the operational position of the housing member 32. The broken line 34′ shows the position of the lower edge of the housing member 32 when it assumes its rest position during a stoppage of the spinning machine. The movement of the housing member 32 is aided or opposed, as the case may be, by a spring or by pneumatic forces, and is effected by a setting mechanism 35 which is connected through a line 36 to the controller 17 which also controls the motor 28 of the low-pressure generator 29 via a line 37.

A thread clamping and severing fixture is located in spaced axial relation to the thread drawoff tube 31 in the path of the thread 6. This fixture includes a locally fixed clamping and severing anvil 38 and a locally fixed setting device 39 in which a clamping block 40 and a severing tool 41 are mounted for independent sliding movement. A line 42 connects the setting device 39 to the controller 17.

FIG. 1 shows the position of all the machine members while the machine is running, i. e., during the spinning process. In that case, the two clutches 15 and 24 are engaged and the drive gear 22 is so driven by the output gear 20 that the wind-up spool 8 rotates in the direction of the arrow.

The spinning machine is stopped by electrical signals received from the controller 17 which are fed through line 27 to the motor 9 and which cause a constantly decreasing speed of rotation and hence also decelerate the other moving machine members. When the driven machine members have reached the so-called reattachment rpm, i. e., when they rotate near that rpm which forms the lower limit for the spinning process, a signal may be delivered through line 37 to reduce the rpm of motor 28 which also reduces the suction power of the low-pressure generator 29. At the same time, signals are sent through lines 16 and 25 to disengage the clutches 15 and 24, respectively, whereby the feed roller pair 3, the thread drawoff roller pair 7 and the wind-up spool 8 are released and may run down to standstill. If necessary, rapidly acting brakes may be used to act on these members. When the feed roller pair 3 is stopped, the spun thread 6 breaks; suitable timing of the arresting process of the roller pairs 3 and 7 makes it possible that, when the thread drawoff roller pair 7 and the wind-up spool 8 are stopped, the end of the broken thread is still located within the thread drawoff tube 31. At this time, the controller 17 delivers a signal through line 36 to the setting mechanism 35 which, therefore, shifts the housing member 32 into the position suggested by the broken line 34′. In this position, the whorl 12 of the spinning rotor 5 is lifted from the tangential drive belt 11 and that end of the thread drawoff tube 31 nearest the clamping and severing fixture 38–41 moves into the position suggested by the broken line 31′, i. e., it is spatially separated from the fixture 38–41. At the same time, the controller 17 delivers a first signal through the line 42 to the setting device 39 which causes a sliding displacement of the clamping block 40 which clamps the thread 6 on the clamping and severing anvil 38. Shortly thereafter, the controller 17 delivers a second signal which slidingly displaces the severing tool 41 which severs the thread and thereafter returns to its starting position.

The severed piece of thread, whose broken end still lies in the thread drawoff tube 31, is then sucked into the interior of the spinning rotor 5 due to the low air pressure still prevailing in the thread drawoff tube 31 and is removed from the spinning rotor together with the remainder of the fibers located therein. Finally, the controller 17 delivers a signal for shutting off the motors 9 and 28.

In order to re-start the machine and to begin the thread re-attachment process, the controller 17 first delivers signals for starting the motors 9 and 28 until these motors have reached a speed which is suitable for thread attachment. Soon after the switch-on, the setting mechanism 35 slides the housing member 32 back into its operative position, thereby moving the whorl 12 back in contact with the drive belt 11. At the same time, the thread drawoff tube 31, whose suction orifice lies outside of the housing member 32, moves far enough toward the severed end of the thread which is still being held by the clamping member 40 that the end of the thread is located within the effective suction space due to the reduced air pressure prevailing in the tube 31. The controller 17 then delivers signals for returning the clamping block 40 into the position where it releases the thread and then delivers further signals for engaging the clutch 24 and for so switching the transmission gears 19 that the output gear 21 is associated with the drive gear 22. Hence, the thread drawoff roller pair 7 and the wind-up spool 8 rotate in the direction opposite to the arrow, causing a return motion of the thread whose free end is then sucked into the thread drawoff tube 31. By choosing a suitable reduction ratio of the transmission 9, this reversal motion can be made slower than the drawoff motion which proceeds in the opposite direction. At the proper time, a signal is delivered which engages the clutch 15 and starts the rotation of the feed roller pair 3. The timing is so chosen that the reversing thread end reaches the fiber collection groove of the spinning rotor 5 at the same time as the fibrous material 2 to be spun into thread. At this point, the controller 17 delivers a signal to the transmission gear 19 for disengaging the output gear 21 and for reengaging the output gear 20 to the drive gear 22, thus causing the re-attached thread to be drawn off. Finally, the controller 17 delivers signals which cause the motors 9 and 28 to be switched to their operational rpm.

Figure 2:
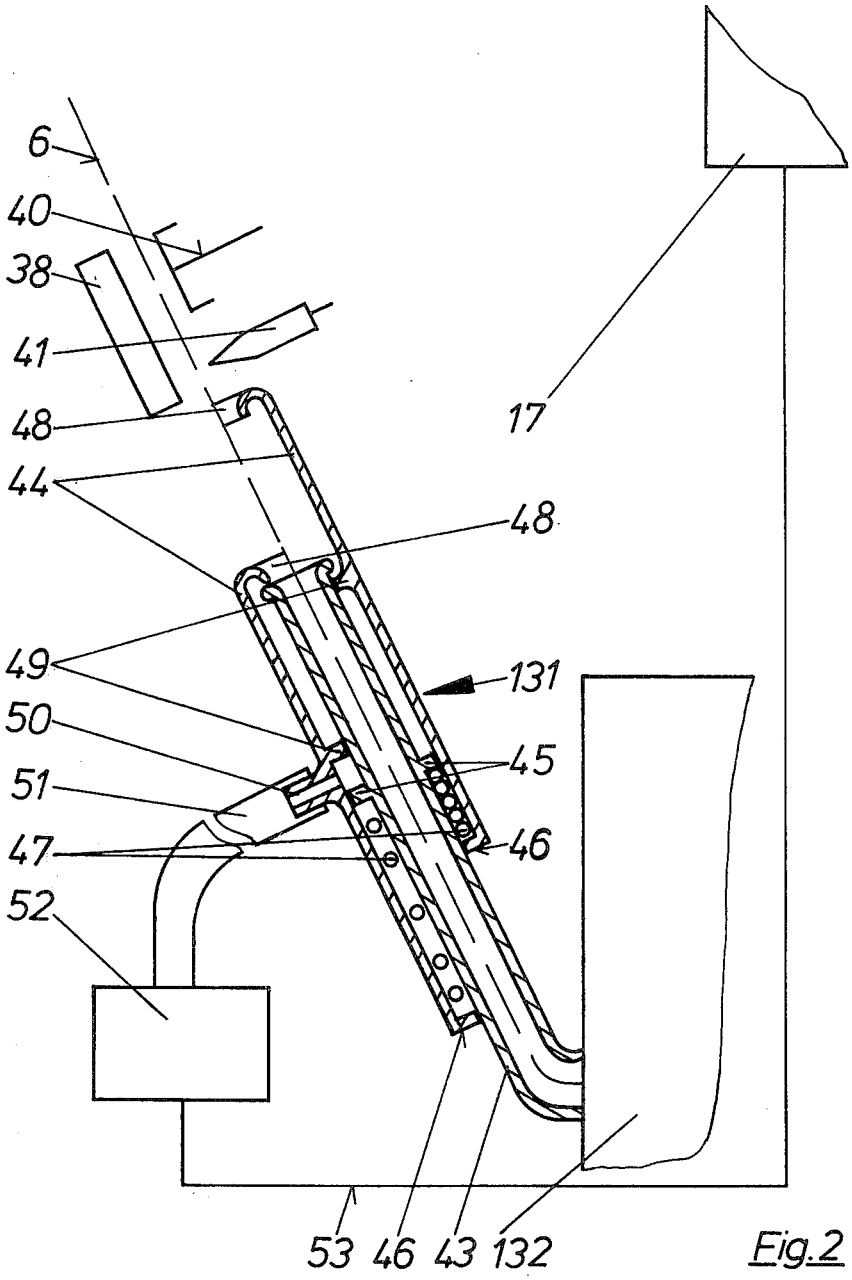
FIG. 2 is an enlarged partial representation of a thread drawoff tube of different construction from that shown in FIG. 1.

In the exemplary embodiment according to FIG. 2, the housing member which corresponds to housing member 32 in FIG. 1 carries the reference numeral 132. It is also equipped with a thread drawoff tube 131, which, in contrast to tube 31 of FIG. 1, consists of two telescoping tube sections, whereby the inner tube section 43 is fastened to the machine member 132 and the outer tube section 44 slides on it externally. In FIG. 2, the externally sliding tube section 44 is shown, to the left of the thread 6, in its fully retracted position and it is shown to the right of the thread in its fully extended position with respect to the interior telescoping member 43. One end of a compression spring 47 rests on a shoulder 45 of the tube section 43 and the other end rests on a bottom edge 46 of the tube section 44. The spring 47 urges the telescoping tube into its retracted position in which the orifice 48 is so far removed from the clamping and severing fixture 38, 40, 41 that the severed end of a clamped thread lies outside of the effective suction region of the low pressure prevailing in the thread drawoff tube 131. In its extended position, the suction orifice 48 of the thread drawoff tube 131 is near the end of the thread which then lies within the effective suction region of the tube. The displacement of the outer tube section 44 in opposition to the force of the compression spring 47 is effected by a pressure medium, for example by air, which is admitted through a hose 51 or the like from a container 52 and which is admitted through a nipple 50 on the tube section 44 and becomes effective in the hollow space formed between, on the one hand, the shoulder 45 of the tube section 43 which sealingly attaches to the tube section 44 and, on the other hand, a shoulder 49 of the tube section 44 which sealingly attaches to the tube section 43. The controller 17 actuates the fluid flow via a line 53 in such a manner that, at the latest at the beginning of the reversal motion of the severed thread released from the clamping fixture for the purpose of re-attachment, the tube orifice 48 is so close to the end of the thread that the latter is engaged by the suction at the orifice and pulled into the tube.

If suitable, the device according to FIG. 2 can be disposed, similar to the manner shown in FIG. 1, on a movably mounted housing member 32, e. g. if the inherent motions of this device do not suffice to bring the tube orifice close enough to the end of the thread which is to be aspirated. However, the apparatus may also be disposed on a housing member which is stationary relative to the clamping and severing fixture or, again, it may be disposed in a manner and in a way which, by itself, cannot produce a movement of the tube orifice to the end of the thread.

Instead of causing the reverse motion of the rollers 7 and of the spool 8 for backspacing the thread, it is possible to release an appropriately large thread reserve which may be formed, for example, in the space between the fixture 38–41 and the roller pairs 7. For example, this thread reserve may be formed by reversing rollers of which at least one can be adjusted in position to change the length of the effective reserve thread path.

Figure 3:
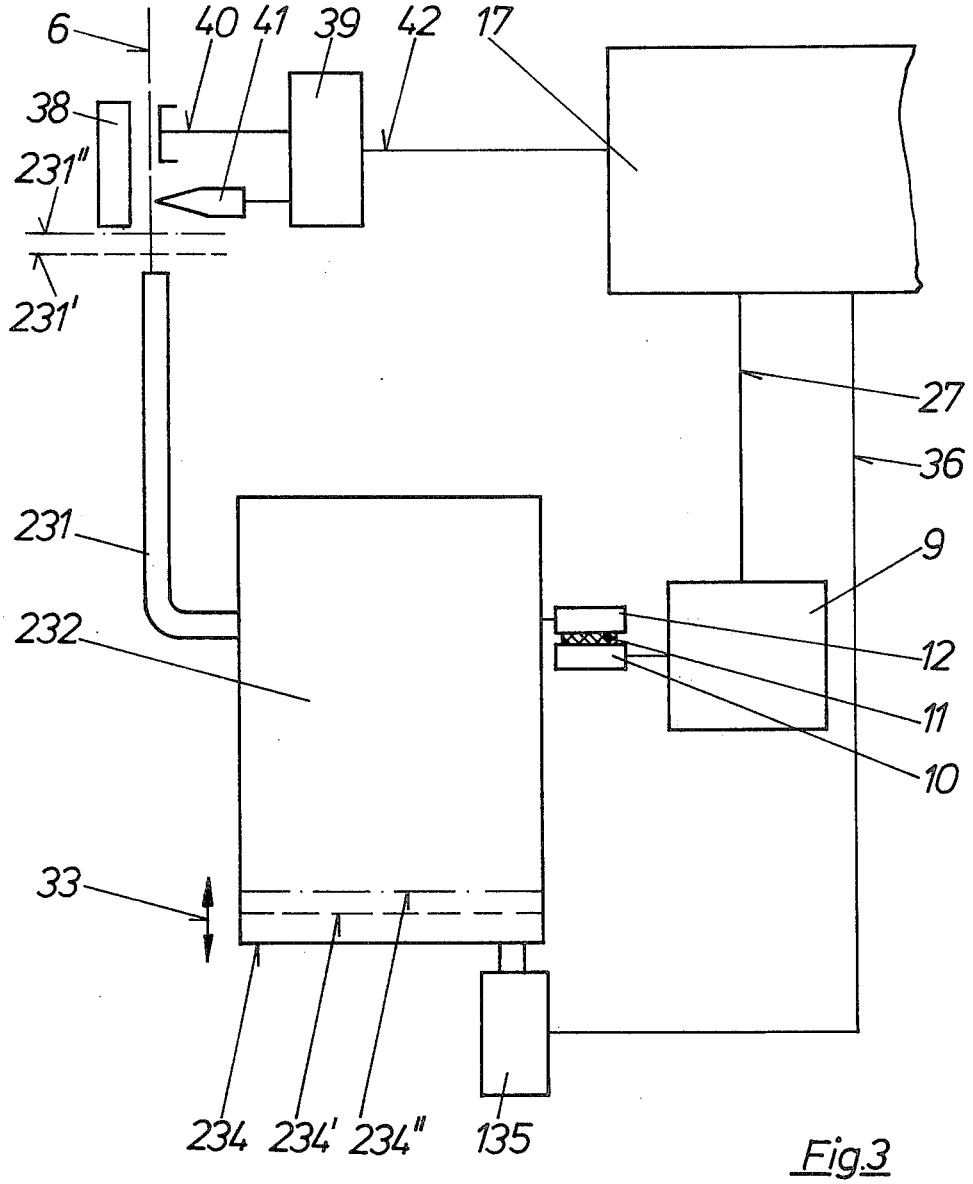
FIG. 3 is a simplified representation of a third exemplary embodiment of the invention.

FIG. 3 shows an apparatus which substantially corresponds to that of FIG. 1, except that a rigid thread drawoff tube 231 is mounted on a housing member 232 and is slidably movable in the direction indicated by the arrow 33, with its operational position being the lower position which is shown in solid lines. Signals delivered by the controller 17 through the line 36 to the setting mechanism 135 may move the housing member 232 to a first position, in which its lower edge 234 is actually located as shown by the broken line 234′, which corresponds to the rest position of this member when the spinning machine is standing still. In that position, the whorl 12 of the spinning rotor is lifted off from the tangential drive belt 12 and the orifice of the thread drawoff tube 231 lies in the plane indicated by the broken line 231′.

When the spinning machine is first turned on, the controller 17 delivers a signal to the setting mechanism 34, which causes the housing member 232 to be lifted into that position in which its lower edge 234 lies along the dash-dot line 234″. At the same time, the suction orifice of the thread drawoff tube 231 is moved into the plane suggested by the dash-dot line 231″. Only then is the suction orifice close enough to the thread located in the clamping and severing fixture 38–41 so that it lies within the effective suction region of the low pressure prevailing in the thread drawoff tube 231 and may be aspirated into the thread drawoff tube 231 since it is released from the clamp, while being back-spaced. Thereafter, the controller 17 delivers a signal to the setting mechanism 134 which causes the housing member 232 to move into its operational position, as shown in solid lines, in which the end of the thread introduced into the rotor 5 is re-attached to the fiber.

The apparatus according to FIG. 3 has the particular advantage that, during the operation of the spinning machine, the suction orifice of the thread drawoff tube 231 is quite far removed spatially from the clamping and severing fixture 38–41 and is thus easily accessible if a thread breakage is to be repaired by manual insertion of the end of the thread into the drawoff tube. This insertion is not as simple when the suction orifice is located too near the fixture 38–41 while in the operational position.

The invention may preferably be used to ensure that all threads of an open end spinning machine or at least the threads at one side of an open end spinning machine are at the same time reliably re-attached during the re-starting of the spinning machine to the unspun fibres in the spinning rotors. In this case it may preferably be provided that all clamping members resp. all movable separating members resp. all movable drawoff tube orifices are operated commonly, and can be arranged in some applications in groups at corresponding machine members to that each group of such elements is movable together by movement of the corresponding machine member. But the invention could also be provided for that case that threads which are broken at different times during the spinning operation of the spinning machine can be reliably re-attached to the unspun fibres in the corresponding spinning rotors. In this latter case it is preferably provided that each drawoff tube orifice is setting in different relative positions independently of other drawoff tube orifices with respect to the corresponding clamping and severing fixture which is also independently operable of the other clamping and severing fixtures.

It will be understood that the invention is not limited to the described embodiments since there are many other possibilities to realize the invention in practice.

What is claimed is:

1. An open-end spinning machine with a plurality of apparatus for re-attaching a thread, each apparatus including a fixture which holds the thread and severs it at a predetermined distance from the fiber collection groove of the spinning rotor, and a thread drawoff tube with an orifice, through which air passes to the spinning rotor, the improvement comprising:

A. a clamping and severing fixture located on the spinning machine for engaging and holding a broken thread in spaced axial relation to said thread drawoff tube;

B. a reciprocable housing member, mounted on the spinning machine, associated with the spinning rotor and the thread drawoff tube; and C. a setting mechanism, mounted on the spinning machine for positioning said reciprocable housing member between a first relative position and a second relative position with respect to said clamping and severing fixture.

2. An open-end spinning machine as defined in claim 1, wherein said spinning rotor has a drive whorl driven by a tangential belt and wherein said housing member is so disposed that, in at least one of the positions occupied by said housing member said drive whorl is released from said tangential belt.

3. An open-end spinning machine as defined in claim 1, the improvement further comprising:

D. a second setting mechanism, mounted on the spinning machine, for imparting motion to said thread drawoff tube to change the relative position of the orifice thereof with respect to said housing member.

4. An open-end spinning machine as defined in claim 3, wherein said thread drawoff tube is constructed of at least two telescoping sections, one of which includes said orifice.

5. An open-end spinning machine as defined in claim 1, wherein said setting mechanism in each of said plurality of apparatus operates in unison with every other of said setting mechanisms.

6. An open-end spinning machine as defined in claim 1, wherein said setting mechanism in each of said plurality of apparatus operates independently of every other of said setting mechanisms.

7. An open-end spinning machine as defined in claim 1, wherein at least one of said relative positions of said housing member locates the orifice of said drawoff tube such that the end of said broken thread held in said clamping and severing fixture is subject to the influence of suction emanating from said orifice.

8. An open-end spinning machine as defined in claim 7, wherein said setting mechanism is arranged to retract said housing member from said first position adjacent to said clamping and severing fixture into said second position, the thread held by said clamping and severing fixture being released in said first position to be sucked by said thread drawoff tube back into said rotor for re-attachment.

9. An open-end spinning machine as defined in claim 8, wherein said housing member is returned to said first position from said second position to re-start continuous thread spinning.

10. An open-end spinning machine with a plurality of apparatus for re-attaching a thread, each apparatus including a fixture which holds the thread and severs it at a predetermined distance from the fiber collection groove of the spinning rotor, and a thread drawoff tube with an orifice, through which air passes to the spinning rotor, the improvement comprising:

A. a clamping and severing fixture located on the spinning machine for engaging and holding a broken thread in spaced axial relation to said thread drawoff tube; and B. a setting mechanism, mounted on the spinning machine, for imparting linear motion to said thread drawoff tube to set the relative positions of said orifice thereof with respect to said clamping and severing fixture.

* * * * *